US007207287B2

(12) United States Patent
Beech

(10) Patent No.: US 7,207,287 B2
(45) Date of Patent: Apr. 24, 2007

(54) BOAT CONTROL DEVICE

(75) Inventor: Joseph C. Beech, Tracy, MN (US)

(73) Assignee: Lindy-Little Joe, Inc., Brainerd, MN (US)

( * ) Notice: Subject to any disclaimer, the term of this patent is extended or adjusted under 35 U.S.C. 154(b) by 0 days.

(21) Appl. No.: 11/320,038

(22) Filed: Dec. 28, 2005

(65) Prior Publication Data

US 2006/0207490 A1 Sep. 21, 2006

Related U.S. Application Data

(60) Provisional application No. 60/661,692, filed on Mar. 15, 2005.

(51) Int. Cl.
*B63B 21/48* (2006.01)

(52) U.S. Cl. ..... 114/311

(58) Field of Classification Search ..... 114/293, 114/294, 311, 343; 441/22
See application file for complete search history.

(56) References Cited

U.S. PATENT DOCUMENTS 1,575,134 A 3/1926 Stocking
1,897,018 A 2/1933 Draheim
2,818,042 A 12/1957 Manhart
4,481,900 A 11/1984 Rutten et al.
4,534,306 A * 8/1985 Rutten et al. ..... 114/311
4,632,051 A 12/1986 Raymond et al.
4,733,628 A 3/1988 Baughman
4,753,423 A 6/1988 Ukai et al.
4,766,837 A 8/1988 Parish
4,926,780 A 5/1990 Wiehagen
5,025,746 A 6/1991 Boulter
5,062,379 A 11/1991 Cherry
D329,220 S 9/1992 Pauley et al.
5,241,922 A 9/1993 Allen
5,394,817 A 3/1995 Kaufman
5,463,971 A * 11/1995 Abernethy ..... 114/311
6,135,046 A 10/2000 Beech
6,550,413 B2 4/2003 Fiorentino et al.
6,684,808 B2 2/2004 Callahan

FOREIGN PATENT DOCUMENTS

GB 2 115 362 9/1983

* cited by examiner

*Primary Examiner*—Lars A. Olson
(74) *Attorney, Agent, or Firm*—Kinney & Lange, P.A.

(57) ABSTRACT

A drift bag that includes one or more narrowing members to reshape a mouth of the drift bag in the vertical direction to reduce a draft of the drift bag.

20 Claims, 4 Drawing Sheets

BOAT CONTROL DEVICE

CROSS-REFERENCE TO RELATED APPLICATION(S)

This application claims the benefit of Provisional Application No. 60/661,692 filed on Mar. 15, 2005 by Joseph C. Beech and entitled "Boat Control Device."

INCORPORATION BY REFERENCE

The aforementioned Provisional Application No. 60/661,692 is hereby incorporated by reference in its entirety.

BACKGROUND OF THE INVENTION

The present invention relates generally to boat control devices. More specifically, the present invention relates to drift bags (or sea anchors) for use in boat control.

Drift bags are used to control the motion of boats for various reasons. For example, anglers use drift bags to dampen the affects of wind, waves, and/or currents to slow the rate of boat drift for bait presentation purposes.

BRIEF SUMMARY OF THE INVENTION

The present invention is a drift bag that includes one or more narrowing members to reshape a mouth of the drift bag in the vertical direction to reduce a draft of the drift bag when deployed in water.

DETAILED DESCRIPTION

The drift bag of the present invention includes a mouth with an adjustable opening in the vertical direction when deployed in a water environment. This adjustable opening can be narrowed in the vertical direction, which causes drift bags of the present invention to have shallower drafts than other drift bags having mouths with similar-sized circumferences. This feature allows drift bags of the present invention to navigate shallower water depths without striking the bottom, which can avoid damage caused by sharp bottoms such as, for example, rocks, reefs, coral, or oyster beds.

Figure 1:
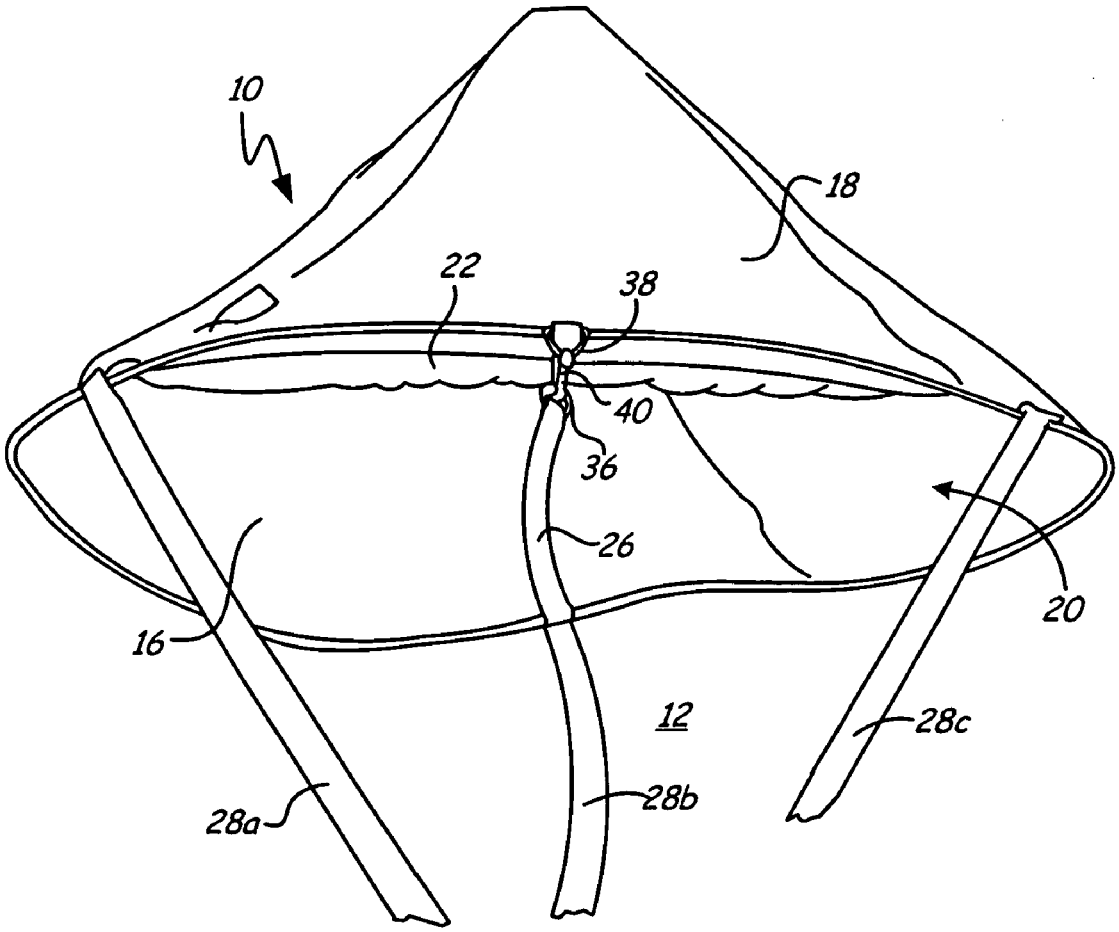
FIG. 1 is a top perspective view of a drift bag of the present invention including a narrowing strap.
Figure 2:
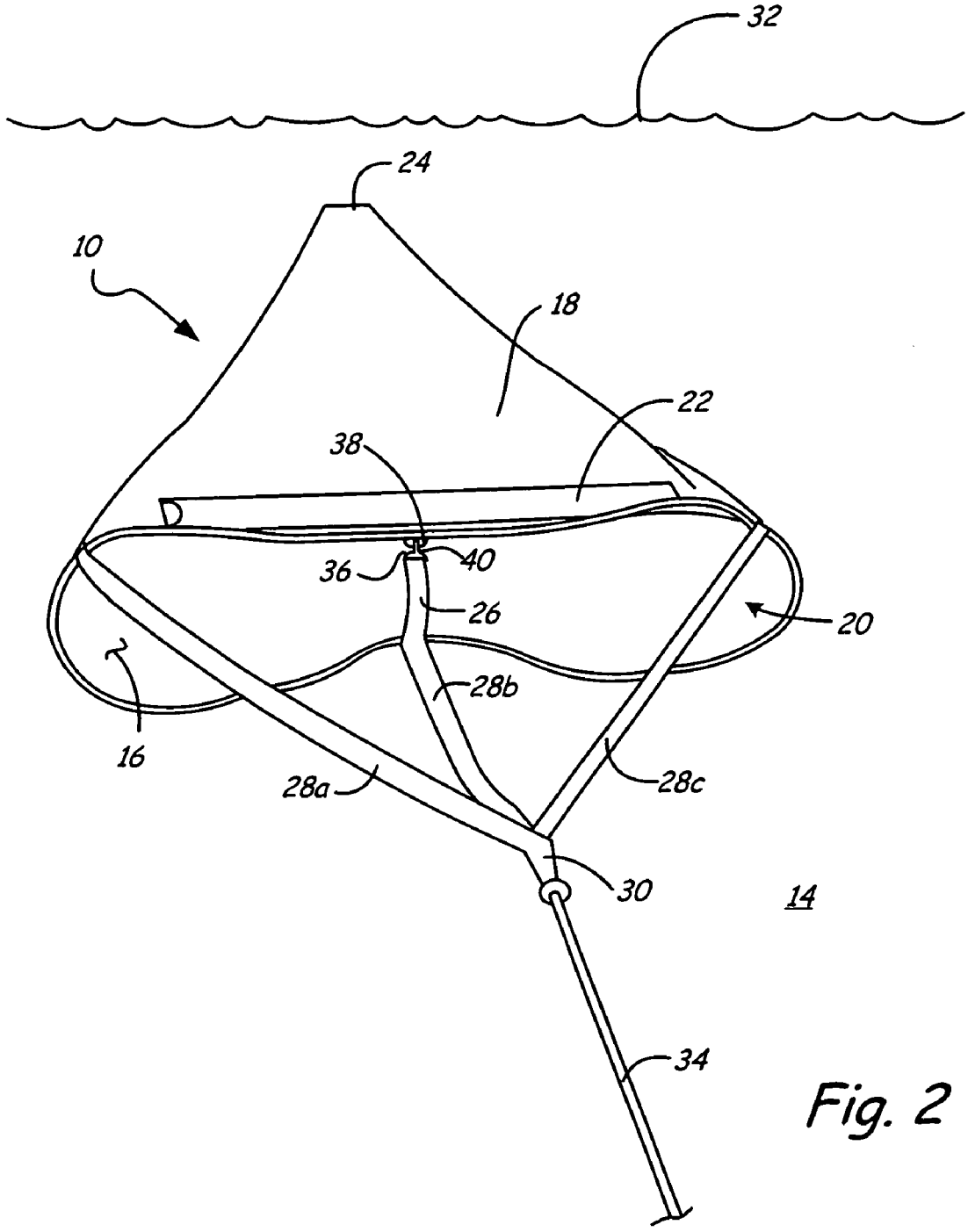
FIG. 2 is a top perspective view of the drift bag of FIG. 1 deployed in a water environment.

FIGS. 1 and 2 show drift bag 10 of the present invention, with FIG. 1 showing drift bag 10 positioned on dry surface 12 and FIG. 2 showing drift bag 10 deployed in water environment 14. Drift bag 10 includes interior surface 16, exterior surface 18, mouth 20, float 22, trailing edge 24, narrowing strap 26, tether straps 28*a*–28*c*, and connector 30. As shown in FIG. 2, float 22, which is sewn (or stitched) into drift bag 10 adjacent to mouth 20, prevents drift bag 10 from sinking and keeps a portion of drift bag 10 at or above surface 32 of water 14.

Tether straps 28*a*–28*c* are each attached at one end to spaced locations of exterior surface 18 and at another end to connector 30. In one embodiment, the other ends of tether straps 28*a*–28*c* are sewn together to form connector 30 in the form of a loop. As shown in FIG. 2, drift bag 10 is connected to tow rope 34 via connector 30 and is being towed through water 14 in the direction of tow rope 34. Trailing edge 24 defines an exit aperture such that as drift bag 10 is towed through water 14, water 14 enters an interior of drift bag 10 defined by interior surface 16 through mouth 20 and exits through an exit aperture (or outlet)defined by trailing edge 24. Tow rope 34 can be attached to a boat so that drift bag 10 resists movement of the boat.

Narrowing strap 26 reshapes mouth 20 by narrowing the opening size of mouth 20 in the vertical direction relative to the opening size of mouth 20 in the horizontal direction (i.e., the direction substantially parallel to surface 32 of water 14). As shown in FIGS. 1 and 2, end 36 of narrowing strap 26 is releasably attached to mount 38 of mouth 20 via snap fastener 40. When narrowing strap 26 is connected to mount 38, the shape of mouth 20 is narrowed in the vertical direction so that drift bag 10 has a shallower draft when being towed in water 14. As compared to conventional drift bags, this feature allows larger-sized drift bags of the present invention (i.e., drift bags having mouths 10 with larger circumferences) to be deployed in shallow water environments without striking the bottom. The ability to use larger-sized drift bags in shallow water environments allows for additional boat control, especially for larger boats.

Any type of fastener may be used in place of, or in addition to, mount 38 and/or fastener 40 to attach narrowing strap 26 to drift bag 10. Examples of suitable fasteners include clips, stitching, glue, bolts, clamps, couplings, hooks, locks, lugs, rivets, screws, and combinations of these. In some embodiments, narrowing strap 26 is fixedly attached on one or both ends to drift bag 10.

Figure 3:
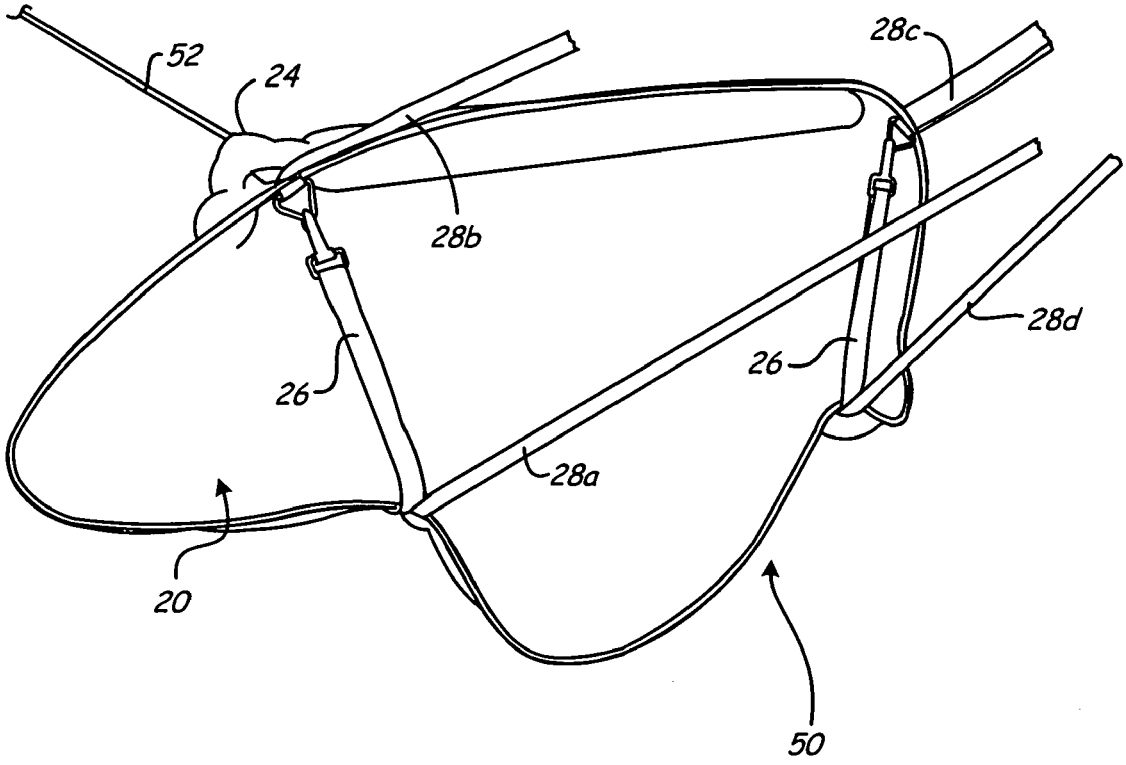
FIG. 3 is a top perspective view of a drift bag of the present invention including a pair of narrowing straps.
Figure 4:
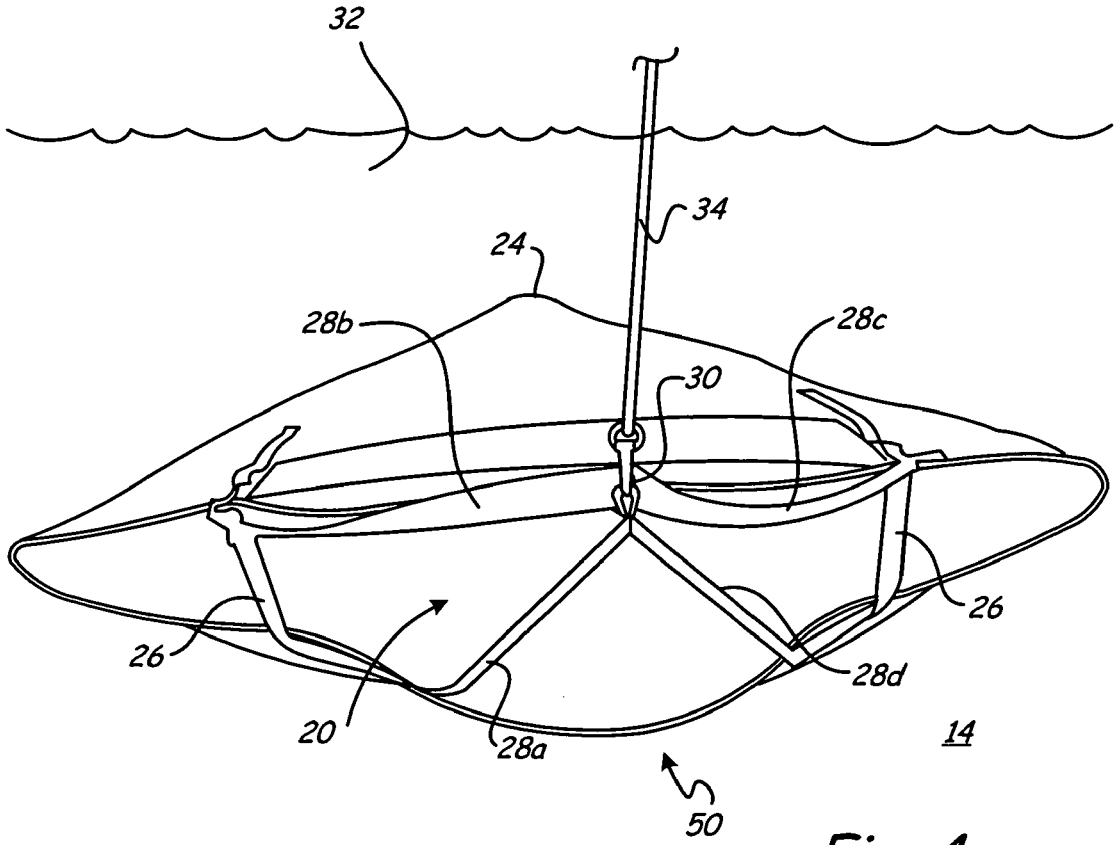
FIG. 4 is a top perspective view of the drift bag of FIG. 3 deployed in a water environment.

In some embodiments, drift bag 10 includes a plurality of narrowing straps 26. FIGS. 3 and 4 show drift bag 50, with FIG. 3 showing drift bag 50 suspended in the air and FIG. 4 showing drift bag 50 deployed in water environment 14. Drift bag 50 is similar to drift bag 10 of FIGS. 1 and 2, except it includes two narrowing straps 26 and an additional tether strap 28*d*. As shown in FIG. 3, a retrieval line 52 is attached to trailing edge 24 to facilitate retrieval of drift bag 50 when deployed in water environment 14.

Other narrowing means or members can be used (besides or in addition to narrowing strap(s) 26) to control the shape of mouth 20 in the vertical direction and achieve a reduced opening size in the vertical direction relative to the opening size in the horizontal direction. Examples of other suitable narrowing members include rods, rope, cables, chains, bars, belts, tethers, any other rigid or semi-rigid structures known in the art, and variations and combinations thereof. As described above for narrowing strap 26, any number of narrowing members may be used to control the shape of mouth 20.

In most embodiments, mouth 20 is outwardly resilient (i.e., biased toward an open position) to prevent mouth 20 from collapsing shut when deployed in water environment 14. In some embodiments, mouth 20 is formed from a resilient expansion hoop: For further discussion of such expansion hoops, see U.S. Pat. No 6,135,046, which is incorporated herein by reference. In some embodiments, interior surface 16 and exterior surface 18 are formed from a plurality of triangular panels of fabric that are sewn together to form a flexible container having a conical shape. For example, interior surface 16 and exterior surface 18 can be formed from 3 fabric panels, 4 fabric panels, 5 fabric panels, or any other number of suitable panels. In one embodiment, interior surface 16 and exterior surface 18 are formed from polyester fabric for saltwater resistance.

Thus, as described above, the present invention is a drift bag that includes one or more narrowing members that allow a shape of a mouth of the drift bag to be adjusted. Using the narrowing member(s), the mouth can be narrowed in the vertical direction to avoid underwater obstacles that may impede, snag, or damage the drift bag.

Although the present invention has been described with reference to preferred embodiments, workers skilled in the art will recognize that changes may be made in form and detail without departing from the spirit and scope of the invention.

The invention claimed is:

1. A drift bag for use in boat control, the drift bag comprising:

a flexible container having a mouth for delivering water to an interior of the container; and a narrowing member attachable at a pair of ends to the flexible container and capable of reshaping the mouth to reduce a vertical dimension of the mouth when the drift bag is deployed in water.

2. The drift bag of claim 1, and further comprising:

a float secured to the flexible container near the mouth.

3. The drift bag of claim 2, wherein the float is secured to the flexible container near an attachment location for attaching one of the pair of ends of the narrowing member to the flexible container.

4. The drift bag of claim 1, wherein the narrowing member comprises a strap for fixedly reducing draft of the drift bag mouth while maintaining circumferential length of the drift bag mouth.

5. The drift bag of claim 1, wherein the resilient container comprises a plurality of flexible panels sewn together.

6. The drift bag of claim 1, wherein the mouth is outwardly resilient.

7. The drift bag of claim 6, wherein the mouth comprises an outwardly resilient expansion hoop.

8. The drift bad of claim 7, wherein the resilient expansion hoop is sewn into to the flexible container.

9. The drift bag of claim 1, wherein the drift bag includes a plurality of narrowing members.

10. The drift bag of claim 1, wherein the flexible container comprises polyester fabric.

11. The drift bag of claim 1, and further comprising:

an outlet in the flexible container to allow water to exit from the interior of the container, wherein the outlet is smaller than the mouth.

12. A drift bag for use in boat control, the drift bag comprising:

a flexible container having a mouth for receiving water into an interior of the container;

means for reshaping the mouth to reduce only a vertical dimension of the mouth when the drift bag is deployed in water; and a float secured to the flexible container near the mouth.

13. The drift bag of claim 12, wherein the reshaping means comprises a plurality of narrowing members.

14. The drift bag of claim 12, wherein the reshaping means comprises a strap attachable at a pair of ends to the flexible container.

15. The drift bag of claim 12, wherein the mouth is outwardly resilient to resist collapsing when the drift bag is deployed in water.

16. The drift bag of claim 15, wherein the mouth comprises an outwardly resilient expansion hoop.

17. The drift bag of claim 12, wherein the flexible container comprises polyester fabric.

18. A drift bag for use in boat control, the drift bag comprising:

a flexible container having a mouth for receiving water into an interior of the container;

a narrowing member attachable at a pair of ends to the flexible container and capable of reshaping the mouth to reduce only a vertical dimension of the mouth to decrease draft of the drift bag when the drift bag is deployed in water while maintaining circumferential length of the drift bag mouth;

a float secured to the flexible container; and a resilient expansion hoop to prevent the mouth from collapsing when the drift bag is deployed in water.

19. The drift bag of claim 18, wherein the float is attached to the flexible container near the mouth.

20. The drift bag of claim 12 wherein the means for reshaping the mouth comprises a strap for fixedly reducing draft of the drift bag mouth while maintaining circumferential length of the drift bag mouth.

* * * * *